United States Patent [19]

Kataoka

[11] 4,431,142

[45] Feb. 14, 1984

[54] WINDER HAVING WINDER SHAFT EXTRACTION DEVICE

[76] Inventor: Hiroshi Kataoka, 1-5-8 Asahi, Iyo-Mishima-shi, Ehime-ken, Japan

[21] Appl. No.: 351,531

[22] Filed: Feb. 23, 1982

[30] Foreign Application Priority Data

Feb. 24, 1981 [JP] Japan ..... 56-24994

[51] Int. Cl.[3] ..... B65H 19/30; B65H 25/22; B65H 35/02

[52] U.S. Cl. ..... 242/68.1; 242/58.6; 414/669

[58] Field of Search ..... 242/46.4, 56.4, 56.5, 242/56.9, 68.1, 72 R, 72 B, 72.1, 75.1, 81, 58.6, 68.7, 79; 248/296; 414/669, 672, 911

[56] References Cited

U.S. PATENT DOCUMENTS

| | | | |
|---|---|---|---|
| 2,736,507 | 2/1956 | Neese et al. | 242/81 |
| 3,416,051 | 12/1968 | Pinto et al. | 242/75.51 |
| 3,481,499 | 12/1969 | Pierson et al. | 414/669 |
| 3,690,583 | 9/1972 | Herman | 242/81 |
| 4,022,392 | 5/1977 | Thomas et al. | 242/46.4 |

*Primary Examiner*—Stuart S. Levy
*Assistant Examiner*—Lloyd D. Doigan
*Attorney, Agent, or Firm*—Oblon, Fisher, Spivak, McClelland & Maier

[57] ABSTRACT

A winder wherein, following completion of the winding operation, a roll receiver is moved from a standby position to a position under the completed sheet roll or rolls and the winding shaft used to wind the roll or rolls is then extracted to free the rolls for removal from the winder. Additionally, the winder is provided with a supply tension control for changing the tension in the web from that in the operation of unwinding the sheet from the web roll to a tension better suited for the winding operation, a winding torque adjuster which adjusts the winding torque by increasing the friction between the winding shaft and the winding core by regulating the air pressure within the hollow center of the winding shaft, and a winding core locking mechanism whereby the winding core is locked in place by spheres provided on the outer surface of a large number of core supporting collars fitted on the winding shaft.

2 Claims, 15 Drawing Figures

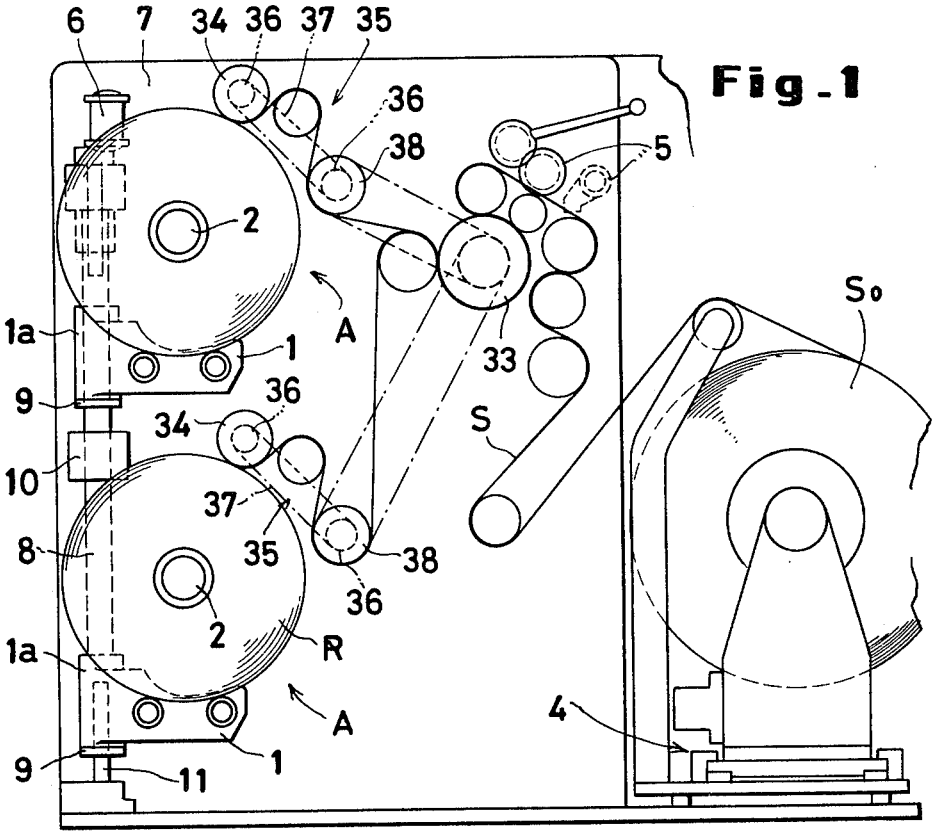
Fig. 1
Fig. 5
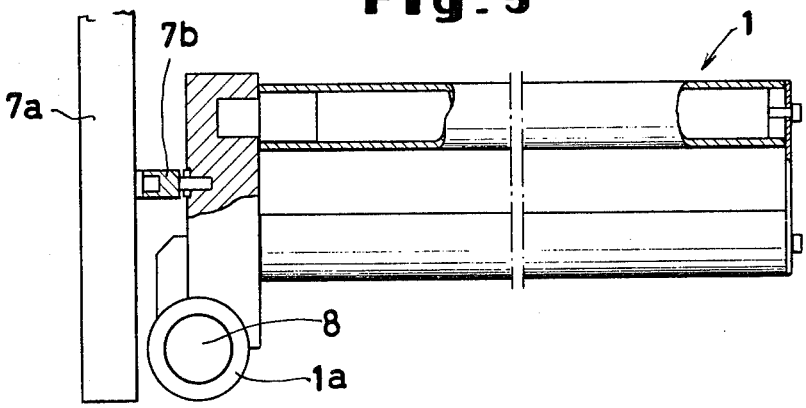

2
26
30
29
28a
28
7a
20
21
27
31b
14
15
16
31
31a
12
17
18
25
19
24
20
21
2
18
17
19
20

WINDER HAVING WINDER SHAFT EXTRACTION DEVICE

BACKGROUND OF THE INVENTION

This invention relates to a winder, more particularly to a winder provided with a winding shaft extraction device. The winding shaft extraction device is a device operated after one or more rolls have been completely wound on the winding shaft of the winder for the purpose of transferring the winding shaft to a position were it is completely removed from the completely wound roll or rolls and for restoring the winding shaft to its operating position after the roll or rolls have been removed from the winder.

In conventional winders the completed rolls are either removed from the winder together with the winding shaft which is then extracted therefrom, or one end of the winding shaft is detached from the winder and, with the other end still supported by the winder, the roll or rolls are pulled off the winding shaft. As this work of removing the rolls from the winding shaft is troublesome, there has been developed a winder wherein the rolls are wound on a tubular paper core rotated in the winder while being supported by cones inserted into its ends. This system cannot, however, be used in a case where a web is slit into a number of strips to be wound into an equal number of sheet rolls.

As will be clear from the embodiment described in the following, in accordance with the present invention it is possible, even in a case where a web is slit into four strips to be wound two on each of two winding shafts, to extract the two winding shafts from the completed rolls to produce four rolls which can then be removed from the winder.

SUMMARY OF THE INVENTION

The object of this invention is to provide a winder wherein the winding shaft can be extracted from the completed sheet rolls so as to make them ready for removal from the winder without first removing the winding shaft from the winder.

Another object of the invention is to provide a speed changing device for the winder which makes it possible to adjust the tension in the web as it passes through the winder from one suitable for unwinding the web from the web roll to one suitable for winding the sheet rolls.

Another object of the present invention is to provide the winder with a winding torque adjuster which adjusts the winding torque by regulating the air pressure within the hollow center of the winding shaft of the winder, and with a large number of collars wich vary the frictional driving engagement in accordance with the air pressure.

Another object of this invention is to provide the composite winding shaft of the winder with a locking mechanism employing spheres, the locking mechanism being provided on the outer surface of the winding shaft to facilitate fitting and removal of the winding cores.

In order to achieve these objects the winder according to the present invention comprises a roll receiver which, following the completion of the winding operation, moves from a standby position to a roll-support position beneath the completely wound roll, and a winding shaft extraction/restoration device for withdrawing the winding shaft from and restoring it to the winding position.

The winder can further be provided with a speed change device for transmitting the rotation of the feed roller for unwinding the web from the web roll to the touch roller which is held in contact with the surface of the sheet roll while it is being wound, this speed change device making it possible to adjust the tension in the web from one appropriate for unwinding the web from the web roll to one appropriate for winding the sheet roll.

Moreover, the winder can be provided with a composite winding shaft comprising a hollow drive shaft, driving members positioned at appropriate locations on the outer surface of the hollow drive shaft and capable of being protruded by the application of compressed air to the interior of the hollow drive shaft, collars loosely fitted onto the hollow shaft and driven by frictional engagement with the outer surface of the driving members, and means for transmitting the rotation of the collars to the winding core. The collars can be provided in a large number extending over the full effective length of the winding shaft. The compressed air can be introduced from one end of the hollow shaft so as to cause an elastic tube to expand and push spheres of the driving members into contact with the inner surface of the collars.

Also, the winder can be provided with a composite winding shaft comprising a large number of collars uniformly spaced in the axial direction, each collar having inclined troughs formed in the circumferential direction on its outer surface and each trough containing a sphere capable of rotating in all directions. With this arrangement, the spheres push upwardly onto a paper core fitted thereover only when they are positioned at a shallow part of the inclined floor of the inclined troughs.

Contrary to the conventional system wherein the completed sheet rolls are removed from the winding shaft after the winding shaft has been removed from the winder, the present invention provides a new system wherein the winding shaft is extracted from the sheel rolls in their as-wound position and then, after the sheet rolls have been removed from the winder, is restored to its winding position. The operation of extracting the driving shaft from the sheet rolls is facilitated by the fact that, following completion of the winding operation, a roll receiver is immediately moved beneath the completed rolls so that the rolls will rest thereon after extraction of the driving shaft, and by the fact that the extraction of the winding shaft can be accomplished by a straight pulling operation. Moreover, the winder according to the present invention permits a considerable simplification of the bearings for the winding shaft since, differently from the conventional system, there is no need to support the winding shaft from one end only while it still bears the heavy weight of the sheet rolls.

The winder according to this invention also makes possible an improvement in operational efficiency since after the roll receiver has received the completed sheet rolls, it can be swung horizontally by some small amount so as to allow the operation of removing the finished sheet rolls and the operations of restoring the winding shaft to its operating position and fitting a new winding core thereon can be carried out at the same time.

As the winding shaft is extracted from the sheet rolls after they are supported on the roll receiver, there is no danger as in the conventional winder of the surface of the sheet rolls being damaged by an impact sustained by falling onto a receiving surface the moment that the winding shaft is extracted.

With the winder in accordance with the present invention, it is also possible to link the feed roller for unwinding the web from the web roll with the touch roller in contact with the sheet roll being wound via a speed change device. In this way, it is possible to adjust the tension in the web to have one level of tension appropriate for unwinding and feeding the web between the web roll and the feed roller and another level of tension appropriate for the winding operation between the feed roller and the sheet roll being wound. As a result of this ability to provide one level of tension for unwinding the web and another level of tension for winding the sheet roll within one and the same path of web travel, there is obtained both an improvement in operating efficiency and an improvement in the quality of the sheet rolls produced.

Further, by the application of air pressure to the interior of the winding shaft, it is possible with the winder in accordance with this invention to have all of the large number of collars provided along the full length of the driving shaft operate with uniform driving force. Thus, as winding force is provided by a number of collars that is proportional to the length of the winding core, the winding torque is proportional to the width of the sheet being wound. Differently from the conventionally used frictional drive collars, there is no difference between the winding force of the collars between the ends and the middle of the winding shaft. By properly adjusting the air pressure applied to the interior of the winding shaft, it is possible to wind the sheet roll using a torque ideally matched to the type of material, thickness and width of the web.

The winder of the present invention can also be provided on the surface of its winding shaft with a locking means consisting of spheres contained in inclined troughs. The principle involved in this locking mechanism is the same as that of the known roller clutch. However, spheres not only provide a check action like that of the rollers of a roller clutch, but also act as ball bearings which facilitate the insertion and extraction of the winding roller to and from the winding cores (paper tubes). Thus the work of insertion and extraction is made much easier than it has been heretofore. What is more, as the core is retained on the winding shaft by spheres, there is no possibility of the interior of the core being damaged or to the surface of the sheet rolls being soiled by paper dust as often happens when the inside of the winding core is gripped in the conventional way by sharp edges that dig into the core material.

BRIEF EXPLANATION OF THE DRAWINGS

FIG. 1 is a front view of one embodiment of the winder according to the present invention, FIG. 5 is a plan view of the roll receiver of the same embodiment.

FIG. 1 is a front view and FIG. 2 a side view of one embodiment of the present invention. The main components of this embodiment are roll receivers 1 which, following the completion of the winding of rolls R, move from standby positions to positions where they support the rolls R from underneath, and winding shaft extraction/restoration devices 3 which extract the winding shafts in their axial directions from the sheet winding positions A and then restore them to the same position.

Figure 2:
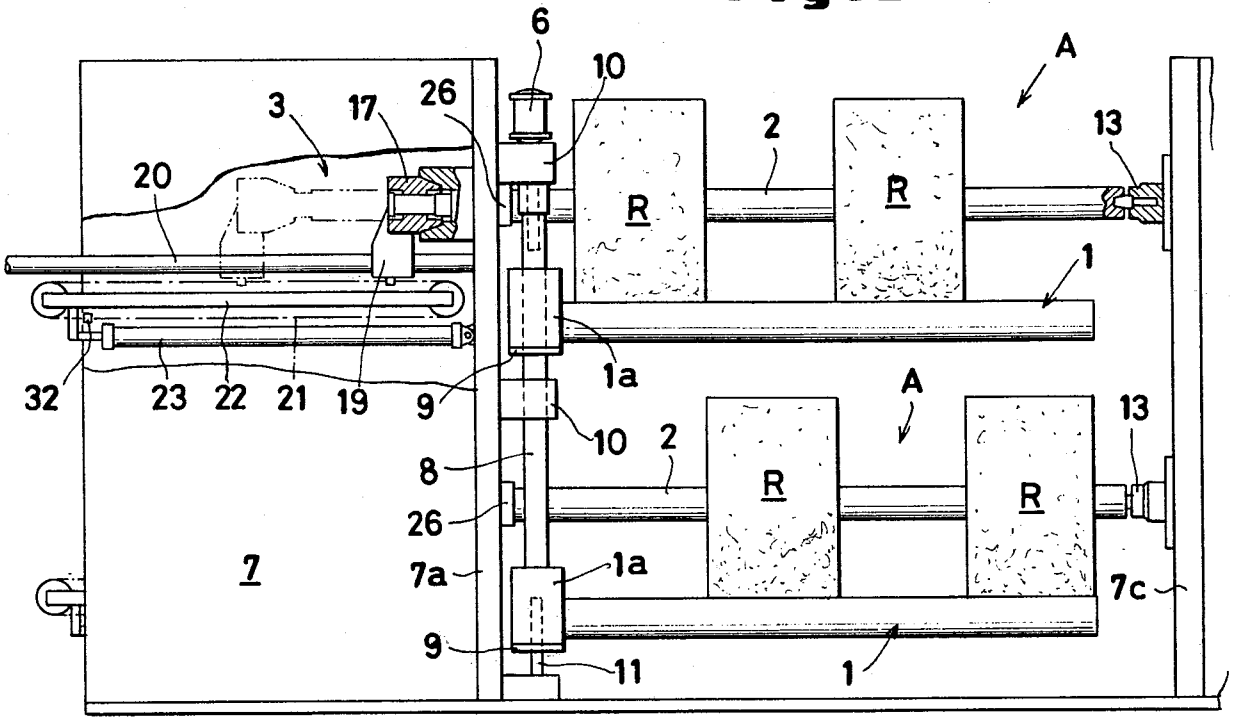
FIG. 2 is a side view of the embodiment of FIG. 1.

The winder of this embodiment also comprises a rewind unit 4 for a web roll $S_o$ and a slitter 5. Web S is drawn from the web roll $S_o$ and passed via a known arrangement of rollers to the slitter 5 where it is in this embodiment slit into four sheets by knife or circular blades, two of which sheets are passed to each of the upper and lower winding shafts 2 to produce a total of four sheet rolls R. (See FIG. 2.) These features of the winder are all well known.

The characterizing feature of this invention becomes apparent at the time the wound sheet rolls are removed from the winder. In conventional winders, the upper and lower winding shafts are either completely removed and replaced with new shafts or each winding shaft is removed from its bearing at one end and swung to one side, whereafter the sheet roll is pushed off the shaft. In the case of this invention, a motor 6 (FIG. 1) is operated to move the roll receivers 1 from their lower standby positions to positions where they support the sheet rolls R from underneath or to positions immediately adjacent to this. Then, the extraction/restoration devices 3 shown in FIG. 2 draw the winding shafts 2 to the left in the same figure to the extent that they are comletely removed from the sheet rolls R but are not extracted from the left bearing.

An explanation will first be made of the structure related to the roll receivers 1 and this will then be followed by an explanation of the structure of the extraction/restoration device.

Each of the roll receivers 1 consists of two horizontal rods fastened together at both ends and supported at one end by a roll receiver support 1*a*. A hollow elevator column 8 is provided to stand along the main frame plate 7*a* of the machine frame 7. On the elevator column 8 are provided upper and lower support flanges 9. The upper and lower roll receiver supports 1*a* rest on the flanges 9 so as to be rotatable about the elevator column 8. The elevator column 8 is supported vertically by supports 10 projecting from the main frame plate 7*a* and vertical support pin 11, and is raised and lowered by the engagement between a male screw rotated by the motor 6 and an internal female screw of the elevator column 8. A stopper 7b extending from the main frame plate 7a stops the roll receiver 1 at the proper position.

Next the winding shaft extraction/restoration device 3 will be described. In this embodiment, the winding shafts 2 are supported on the left end by ball bearings 12 (FIG. 3) and on the right end by center cones 13 on opposing frame plate 7c. The arrangement used on the right end is of the same type as that used conventionally. A special arrangement is, however, employed on the left side and this is shown in an enlarged view in FIG. 3.

To avoid duplication of explanation, only one of the two extraction/restoration devices will be described here on the understanding that the other is of the same construction.

Unlike the winding shaft used in conventional winders, the winding shaft 2 of this embodiment does not have fixed thereon a drive member such as a gear or pulley. Instead it is provided at one end with a clutch 14 which engages and disengages by movement in the axial direction of the winding shaft 2. Also, since it is necessary to urge the winding shaft 2 gently onto the center cone 13 at its opposite end in this embodiment, a coil spring 15 and a traveling spring washer 16 are provided between the clutch 14 and the ball bearing 12 so as to urge the shaft 2 away from the bearings 12 toward the right in the figure.

The two ball bearings 12 are housed within a movable housing 17 which plays an important role in this invention. More specifically, the movable housing 17 constantly maintains the winding shaft 2 in the right position when the shaft 2 is drawn straight out in the axial direction and when it is restored to its initial position.

The mechanism for extracting the winding shaft 2 comprises a nut 18 which fastens the end of the shaft 2 to the movable bearing housing 17 with the bearings 12 therebetween, a carriage 19 engaged with side holes 24 in the movable bearing housing 17 and used for drawing the movable bearing housing outward, rails 20 provided one on either side of the carriage 19, endless chain 21 for driving the carriage 19 along the rails 20, a support frame 22 for the chain 21, and a long hydraulic cylinder 23 for driving the support frame 22 horizontally.

Figures 3, 4:
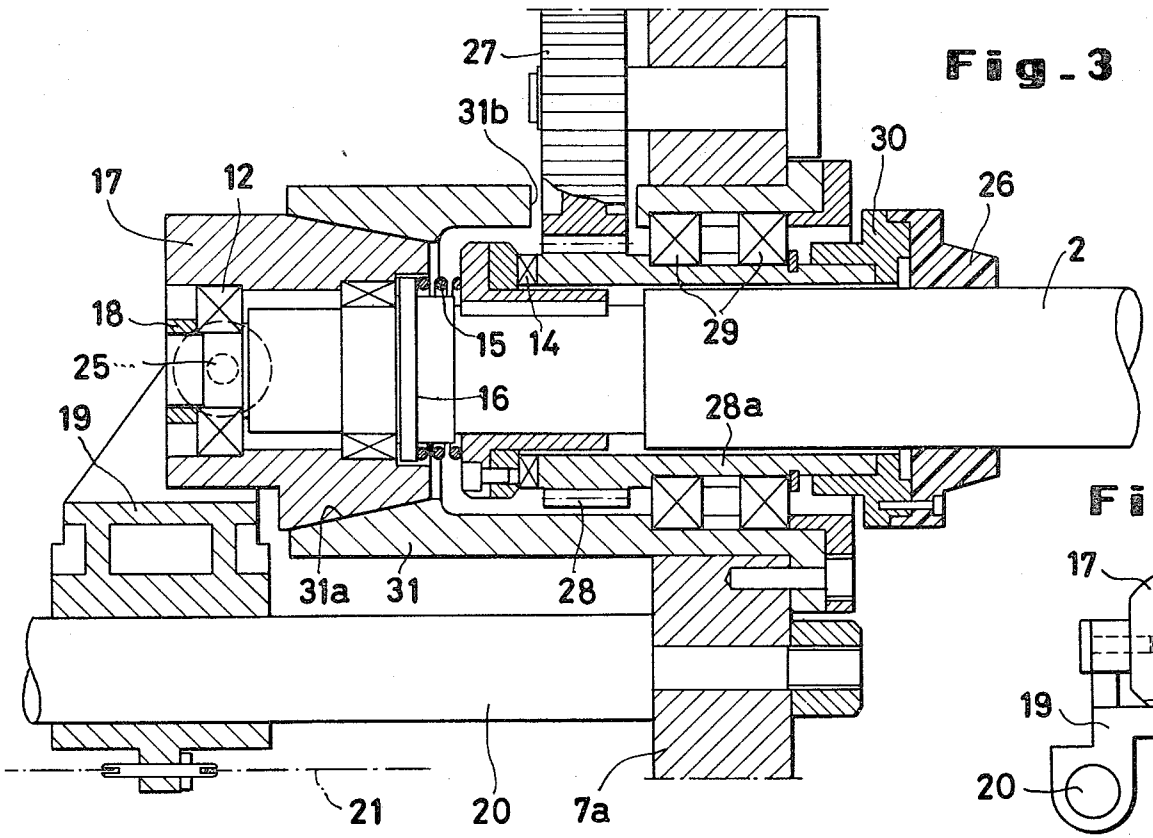
FIG. 3 is a sectional view of the winding shaft extraction/restoration device of the same embodiment.
FIG. 4 is a view of the movable bearing housing and the carriage of the winding shaft extraction/restoration device of the same embodiment as seen in the axial direction of the winding shaft.
Figure 6:
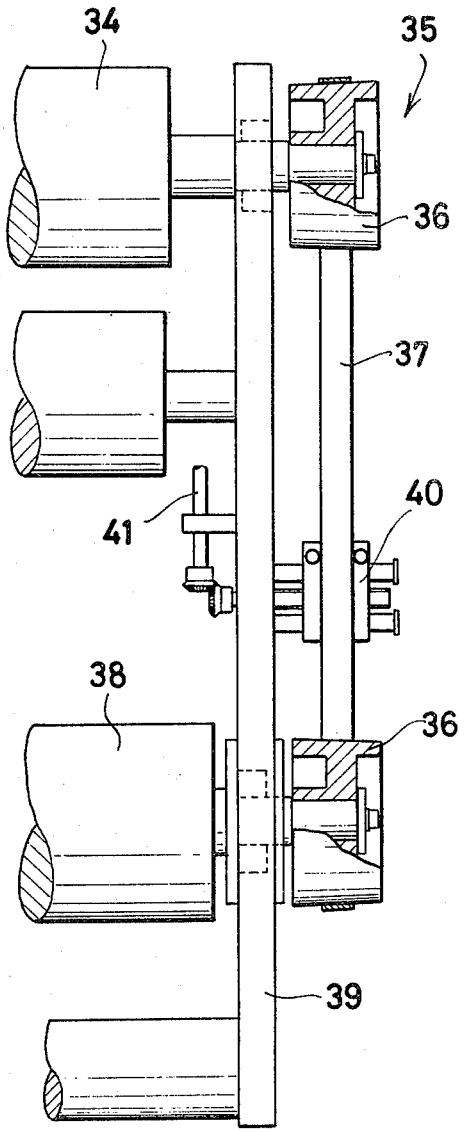
FIG. 6 is a side view of the speed change device for changing the tension of the web of the same embodiment.

FIG. 4 shows the shape of the movable bearing housing 17 as seen in the axial direction. The movable bearing housing 17 and the carriage 19 are connected by pins 25 inserted into the housing 17 from the side of the carriage 19. Although not shown in the drawing, the rails 20 are supported by support members rising from the floor.

The carriage 19 moves by a distance equal to twice the forward and return strokes of the hydraulic cylinder 23. The length of the stroke is set so that in the fully extended state the right end of the winding shaft 2 is completely extracted from both of the sheet rolls R. After the right end of the winding cylinder 2 separates from the center cone 13, the winding shaft is supported by the carriage 19 and a tough resin bearing ring 26. Both the bearing ring 26 and its supporting structure are of special design. The mechanism for driving the winding shaft 2 is, similarly to the arrangement used in conventional winders, mounted on the main frame plate 7a. The final gear 27 of the drive train does not, however, drive a gear on the winding shaft as in convention winders but instead drives an annular gear 28 having a portion for engagement with the clutch 14 on its left end and receiving the winding shaft 2 within its center opening. The annular shaft 28a of the annular gear 28 is rotatably supported at its outer surface by a pair of ball bearings fitted within the main frame plate 7a. Thus when the clutch 14 is engaged, the rotating motion of the gear 28 is transferred to the winding shaft 2. The resin bearing ring 26 is attached to the right end of the annular gear 28 via a connector 30. Therefore, the bearing ring 26 rotates together with the winding shaft 2 during the winding operation and, when the winding shaft 2 is drawn out to be held at only one end, plays an important role as a support for the shaft 2. As the bearing ring 26 is formed of resin, there is no danger of it marring the winding core engaging surface (not shown in detail) of the winding shaft 2.

Though it was stated above that the ball bearings 29 are fitted in the main frame plate 7a, they are not fitted directly into a hole therein but are held within a sturdy support cylinder 31 fitted into a hole in the frame plate 7a. This support cylinder 31 serves as a positioning member for the movable bearing housing 17. More specifically, the left end of the support cylinder 31 is formed with a conical hole 31a shaped to receive the conical right end of the movable bearing housing 17. The conical hole 31a serves not only as a guide for receiving the movable bearing housing 17 in the proper position but also as a compensating member which offsets any precisional error in the members controlling the alignment of the winding shaft 2, namely the rails 20, the carriage 19 and the bearing ring 26 etc., so as to assure proper engagement of the concavity at the right end of the winding shaft 2 with the center cone 13. An opening 31b is provided in the support cylinder 31 for receiving the final gear 27 so as to make it possible to drive the annular gear 28 located inside thereof by means of the drive mechanism located outside thereof.

The method of use and operation of this winder will now be explained. Again, for the sake of brevity, the description will be limited to only one of the two winding shafts 2.

Once the size of the sheet rolls R to be wound has been determined, the roll receiver 1 is moved to a standby position at a point where it does not interfere with the winding operation. Next, the winding drive mechanism (not shown) is put in operation, causing the final gear 27 to rotate the annular gear 28 and rotating the winding shaft 2 which is in the winding position through the clutch 14 and a key provided on the cylindrical portion thereof.

When the sheet rolls R have been rolled to the prescribed diameter, the winding is stopped and the motor 6 is operated to raise the roll receiver 1 until it comes in contact with the underside of the sheet rolls R. Alternatively, the roll receiver 1 may be stopped just short of making contact with the sheet rolls R. At this time the hydraulic cylinder 23 (FIG. 2) is operated to push the support frame 22 to the left. As a consequence, since the chain 21 is fixed at the point 32, carriage 19 engaged therewith is caused to move along the rails 20 by a distance equal to twice the stroke of the cylinder. The movable bearing housing 17 fixed to the carriage 19 is thus moved far enough to the left to pull the winding shaft clamped thereby out of its winding position. More specifically, as the winding shaft 2 moves in its axial direction guided by the rails 20, it slides within the bearing ring 26 attached to the right end of the annular gear 28 until its right end reaches the bearing ring 26, at which point it stops. The sheet rolls R are stopped in their leftward motion by the bearing ring 26 and are left resting on the roll receiver 1.

If desired, the sheet rolls R freed from the winding shaft 2 and left standing on the roll receiver 1 can at this time be removed from the winder by a crane or the like. In this embodiment of the invention, however, the roll receiver bearing the sheet rolls R is first swung horizontally to a position clear of the machine proper prior to removing the rolls R by means of a crane or the like. At the same time this operation of removing the completed rolls R is being carried out, a new winding core is manually fitted over the winding shaft 2 as it is being restored from its extracted position to its position for winding. As a result, the efficiency of the winding operation is increased.

Although the embodiment described in the foregoing is of the type having a slitter and two winding shafts, this invention can, of course, also be applied to a winder having only a single winding shaft.

The basic structure of the winder according to this invention is as described in the foregoing. Next, with reference to FIGS. 1–6, there will be described a web tension control device for provision in conjunction with the basic structure as the occasion necessitates.

The general principle involved in this tension control device is that of controlling the tension in the web S so as to have one level of tension at the time it is drawn from the web roll $S_o$ and another, different level of tension at the time it is wound onto the sheet roll R. This is accomplished by providing a speed changing device 35 through which the rotation of a feed roller 33 for drawing the web S from the web roll $S_o$ is transmitted to a touch roller 34. The speed change device 35 is, for example, constituted of cone pulleys 36 and a belt 37 trained thereon.

The rotation of the feed roller 33 which applies a pinching force on the web S is transmitted to the touch roller 34 which moves in accordance with the growth of the sheet roll R at a changed speed by first passing the rotation of the feed roller 33 to a positionally fixed guide roller 38 and then transmitting the rotation from the guide roller 38 to the touch roller 34 via a speed change device consisting of a pair of cone pulleys 36 and a belt 37 trained thereon. The guide roller 38 is supported on the shaft of a rocker plate (39) supporting the touch roller 34. (FIG. 6) Through the operation of a belt shifter 40, the position of contact between the belt 37 and the cones 36 can be changed so as to finely change the speed of rotation of the touch roller 34. The belt shifter 40 is adjusted by turning the operating shaft 41 by means of a handle (not shown).

Through the operation of this speed change device 35, the operator of the winder can control the tension of the web at the winding stage as by slowing the speed of rotation of the touch roller 34 so as to relieve to a desired degree the stretch occurring in the web S when it is drawn off the web roll $S_o$. An adjustment to increase the stretch is, of course, also possible.

Next there will be described a winding shaft that can be effectively used to control the winding tension in the winder.

Figure 8:
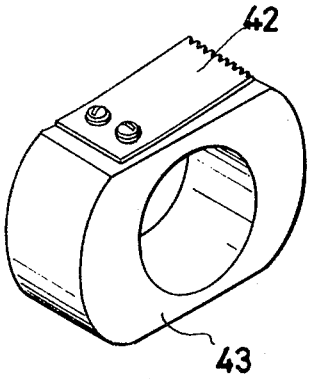
PRIOR ART Fig 8
FIG. 8 is an explanatory view showing the slip collar of FIG. 7.
Figure 9:
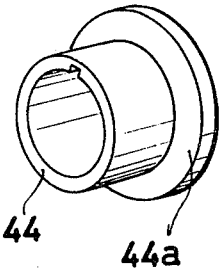
PRIOR ART Fig 9
FIG. 9 is an explanatory view showing the key-slotted collar of FIG. 7.
Figure 7:
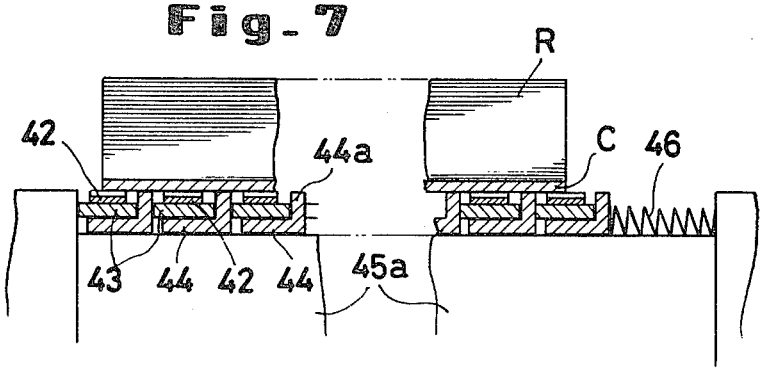
PRIOR ART Fig-7
FIG. 7 is an explanatory view showing the internal structure of a conventional winding shaft.

When, for example, a number of rolls are wound from a single web of wide width slit to prescribed widths by a slitter (longitudinal slitting), the required number of cylindrical winding cores of a length appropriate for the width of the rolls to be produced are fitted over the winding shaft or shafts to be fitted on the winder and the slit widths of the web are wound on these cores to produce the rolls. Conventionally, as shown in FIGS. 7, 8 and 9, the general practice has been to alternately fit on a shaft 45*a* a number of slip collars 43 each having a sawtoothed plate spring 42 designed to dig into the inner surface of a core C and a number of key-slotted collars 44 each having a flange 44*a* for making frictional driving engagement with one of the slip collars 43, and then to press these alternately arranged members into contact with each other through the application of spring pressure in the axial direction so as to convey the rotation of the shaft 45*a* to the plate springs 42. With this arrangement, however, since the torque is transmitted via the frictional drive of numerous collars pressed together in the axial direction by a spring 46 at one end of the winding shaft 45*a*, there has been no way to avoid a pronounced difference between the amount of torque applied to the collars close to the spring 46 and that applied to the collars distant therefrom. The winding shaft of the winder in accordance with the present invention is designed to overcome this problem and makes it possible to provide the high-precision control of web tension and winding torques required to produce the high-quality rolls that have come into demand in recent years.

Figure 10:
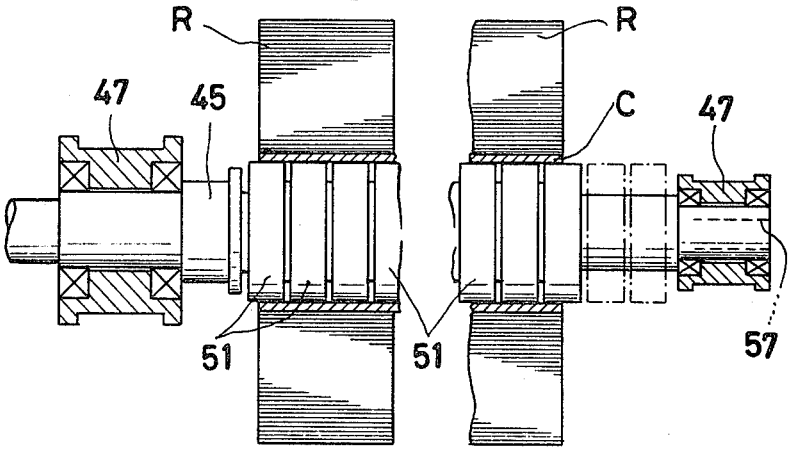
FIG. 10 is an overall view of the winding shaft in accordance with the present invention.
Figure 11:
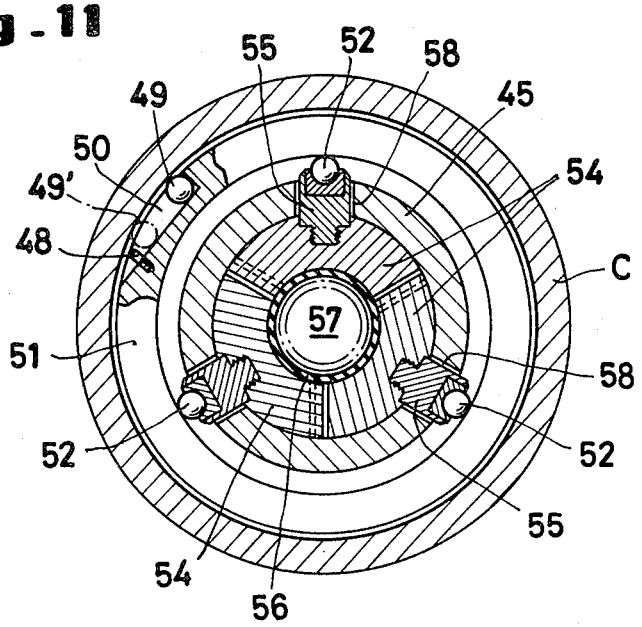
FIG. 11 is a cross-sectional view of the winding shaft shown in FIG. 10.

FIG. 10 shows a front view of the winding shaft and FIG. 11 shows an enlarged cross-sectional view thereof. The left end of the winding shaft as seen in FIG. 10 is engaged with the drive mechanism while the right end thereof is connected with a source of a compressed fluid, for example, compressed air. Neither the drive mechanism nor the source of compressed fluid is shown in the drawing. The winding shaft is supported at its opposite ends by bearings 47 and the portion of the shaft between these bearings 47 has the cross-sectional configuration shown in FIG. 11. Namely, the winding shaft comprises a drive shaft 45 and a plurality of collars 51 fitted thereon. One or more paper tubes (winding cores) C are fitted over the collars 51 and the web S is wound thereon.

The collars 51 are spaced at equal intervals along the axial direction of the drive shaft 45 and are engaged therewith. The equal spacing of the collars 51 may be obtained by arranging the collars side by side with no space therebetween, by separating them by equal distances using spacers, or by any other convenient means.

Figure 12:
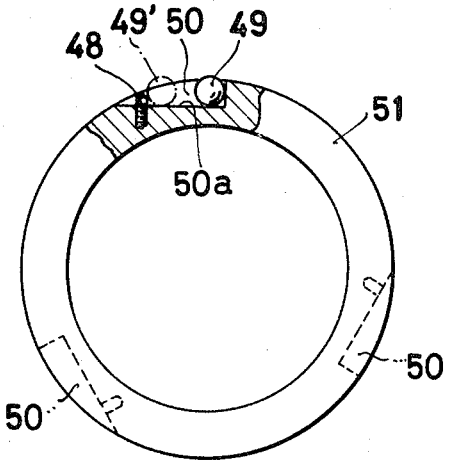
FIG. 12 is front view of a collar of the same winding shaft.
Figure 13:
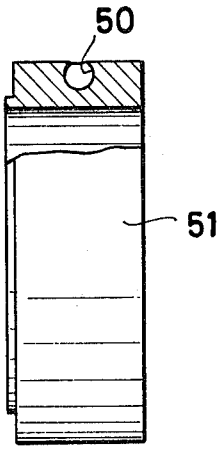
FIG. 13 is a side view of the collar shown in FIG. 12.
Figure 14:
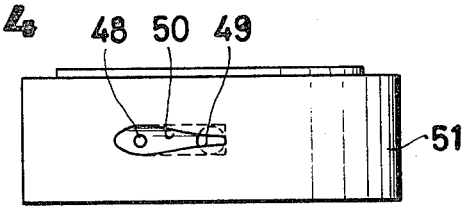
FIG. 14 is a plan view of the same collar.

The structure of the collars is shown in FIGS. 12–14. Each of the collars 51 has inclined troughs 50 formed in the circumferential direction on its outer surface. Within each of the trough 50 is contained a sphere 49, in this embodiment a steel sphere, which is able to rotate in all directions. Only when the sphere 49 is positioned at a shallow part of the inclined floor 50*a* of the trough 50 does it push upwardly onto the paper core C fitted over the collars 51. When the sphere 49 is at a deep part of the inclined floor 50*a*, its outermost point is at a lower level than the outer surface of the collar 51 or, at any rate, even if it is above the surface as shown in a solid line in FIG. 12, it is still within the gap between the outer surface of the collar 51 and the inner surface of the core C. However, when the sphere 49 is moved to the position of the sphere 49′ shown in a chain line at the shallow end of the inclined floor 50*a*, it applies a firm pressure onto the inside of the core C as can be seen from FIG. 11. Therefore, if the core C is subjected to a frictional force so as to resist rotation and the collar 51 is rotated in the clockwise direction in FIG. 11, then the sphere 49 will move to the position 49′ to produce a wedge-like effect engaging the core 51 with the collar 51. If the collar is rotated in the reverse direction, this engagement will be released.

In the illustrated arrangement, the effect of the spheres 49 is obtained at three equally separated points on the collar 51 and each of the three inclined floors 50*a* is provided with a stop pin 48 which prevents the associated sphere from protruding further than the others. As a consequence, the core C is held in a concentric relationship with the collars 51 and the drive shaft 45. Although the troughs 50 shown in the illustrated example were formed by drilling the material on the collar 51 in the tangential direction by use of a jig, it is also possible to form them by using an end mill to machine the collar material from above. In this latter case, the trough formed will have straight walls which are incapable of retaining the sphere. This can be remedied by driving a chisel into the metal at the edges of the trough to push the edges toward the center.

The collars 51 are engaged with the drive shaft 45. In the illustrated example, the collars 51 are driven by frictional engagement with steel spheres 52 protruding from the outer surface of the drive shaft 45. These steel spheres 51 make contact with the inner surface of the collars 51. Each of the spheres 52 is retained within a stud 55 embedded in one segment of a three-segment collar 54. The three-segment collar 54 can be made to expand by introducing compressed air into a rubber tube 56 passing therethrough. When the supply of compressed air is cut off, the rubber tube 56 contracts to the size shown by a chain line, causing the spheres 52 to separate from the collar 51. The studs 55 are accommodated within voids 58 of the drive shaft 45 and exposed at the surface of the drive shaft 45.

As the spheres 52 are pressed onto the collars 51 by the air pressure within the hollow shaft 45, the frictional driving force between the spheres 52 and the collar 51 can be easily adjusted by regulating the magnitude of the air pressure. The spheres 52 are attached to the studs 55 via oil-less metal retainers. The collars 51 are made of a friction resistance material such as hard steel. The engagement between the three-segment collars is attained by the known method of providing a groove on one for engagement with a projection on another so that the collars can be engaged and disengaged freely.

In the foregoing there has been described one example of a winding shaft wherein the winding torque applied to the winding core C can be controlled by regulating the air pressure within the hollow interior of the drive shaft, thereby changing the frictional driving force between the drive shaft and the collars 51 fitted thereon, and of a winding core retaining mechanism employing spheres provided on the outer surface of the collars 51.

It should be noted, however, that it is sufficient for this composite winding shaft to be provided with a hollow shaft (shaft 45 in the drawings), driving members positioned at appropriate locations on the outer surface of the hollow shaft and capable of being protruded by the application of fluid pressure to the interior of the hollow drive shaft (studs 55 and spheres 52) collars loosely fitted onto the hollow shaft and driven by frictional engagement with the outer surface of the driving members, and means for transmitting the rotation of the collars to the winding core. As a consequence, the composite winding shaft has a wide range of applications.

It is preferrable to provide a large number of the collars over the full effective length of the winding shaft. As regards the fluid pressure applied to the interior of the hollow drive shaft, in the example described above, compressed air was introduced from one end of the hollow shaft so as to cause an elastic tube (rubber tube 56 in the drawings) to expand and push the spheres of the driving members into contact with the inner surface of the collars. Although this is a most practical arrangement, it is by no means the only one that can be used and persons skilled in the art will be able to design numerous variations using known techniques.

The winding control system of the winder will now be explained with reference to FIG. 15.

The web S drawn from the web roll $S_o$ is wound into sheet rolls R, only one of which is shown in the drawing. The winding machine is powered by a motor $M_1$ for driving the feed roller 33 and a motor $M_2$ for driving the winding shaft. The rewind unit (denoted by 4 in FIG. 1) for the web roll $S_o$ has a brake B and a tension control unit 60 for the rewound web. The feed roller drive motor $M_1$ has connected therewith an operating pattern control unit 61 which controls all aspects of the motor's operation from the start to the finish of the winding operation, including the motor's operating speed and its rate of acceleration and deceleration at start and stop.

The speed change device 35 is located between the feed roller 33 and the touch roller 34 or between the guide roller 38 which runs synchronously with the feed roller 33 and the touch roller 34. The winding shaft 2 is provided with an air pressure regulator 62 for regulating the pressure of the compressed air supplied to the interior of the hollow shaft and a tension control unit 63 which pattern-controls the winding torque relative to the diameter of the sheet roll R being rolled. The arrow 63*a* pointing toward the control unit 63 denotes an imput signal representing the detected diameter of the sheel roll R. The winding motor $M_2$ is provided with an overdrive control unit 64 for making the required adjustment for slippage in the frictional drive of the winding shaft. 64*a* denotes an imput signal representing the detected diameter of the sheet roll R being rolled.

Figure 15:
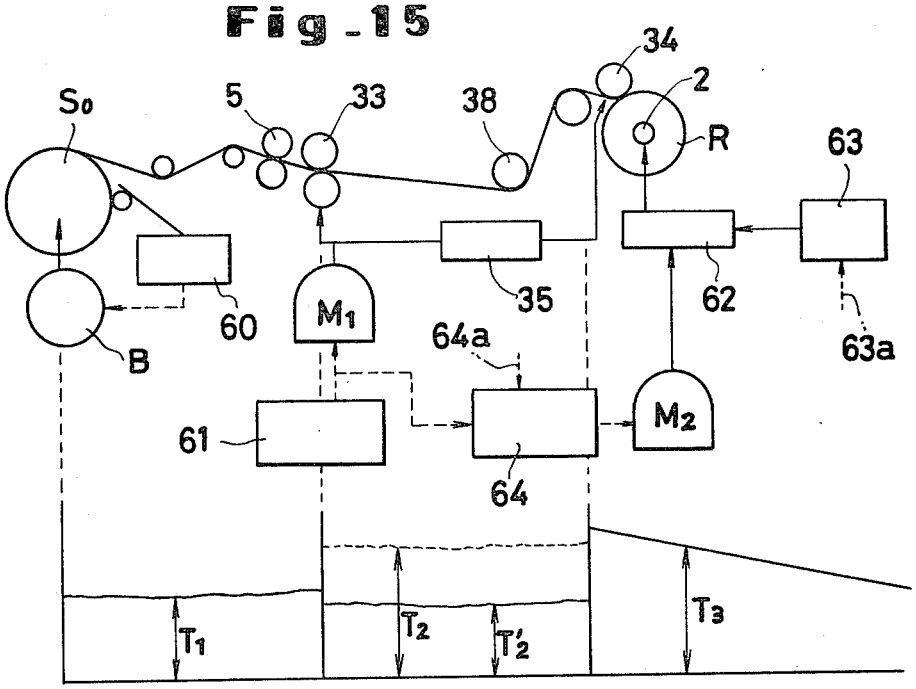
FIG. 15 is a schematic view of the tension control system of the winder according to the present invention.

The line graph shown at the bottom of FIG. 15 indicates the tension in the web at the corresponding positions in the path of web travel through the winder shown in the upper part of the drawing. As will be noted, the path of web travel is divided by the feed roller 33 (a pinch roller) into an unwinding tension zone preceeding it and a supply tension zone following it. The tension in these zones can be set and controlled separately.

This is made possible by the provision of the speed change device 35 which makes it possible to change the speed of the touch roller 34 with respect to the speed of the feed roller 33 so that the web supply tension can be freely adjusted. In other words, the tension in the web upstream of the feed roller 33 can be maintained at a constant value $T_1$ while the tension downstream is adjusted to $T_2$ or $T_2'$ as described. For example, in the case of winding a highly stretchable material such as a polyethylene film, if the material is supplied to the winding unit in the form as stretched in the unwinding process, both the sheet contained in the finished roll and the overall shape of the roll itself will be deformed to such a degree that the roll will lack commercial value.

With the present invention, the tension developed in the web in the unwinding operation can be relieved, raised or lowered as desired. Then the winding tension $T_3$ can be subjected to the known method of taper control wherein the tension of the web is made high at the beginning of the winding and then is lowered progressively as the sheet roll grows in diameter.

What is claimed is:

1. A winder comprising:

a frame plate;

at least one roll receiver supported at one end by said frame plate of the winder in said a manner so as to be movable vertically and rotatable horizontally about a vertical axis and adapted to support at least one sheet roll from underneath at a sheet winding position, said roll receiver being capable of moving from a standby position under a winding shaft to a roll receiving position and from said sheet winding position to a position where the roll is removed, and at least one winding shaft extraction device for extracting and restoring a winding shaft from and to its operating position by moving said winding shaft in its axial direction, said roll receiver being movable upwardly from the standby position to the roll receiving position and the sheet roll being transferrable from the sheet winding position to the position where the roll is removed by horizontally rotating said roll receiver after the winding shaft is extracted from the roll by means of said shaft extraction device wherein operations of removing the roll and fitting a new core over the winding shaft can be carried out simultaneously.

2. A winder according to claim 1, further comprising a speed change device for transmitting the rotation of a feed roller for drawing a web from a web roll to a touch roller in contact with the surface of the sheet roll being wound, said speed change device being constructed and to adjust the level of tension of said web such that said web is wound at a desired torque.

* * * * *